United States Patent [19]

Keith

[11] Patent Number: 4,946,037

[45] **Date of Patent: * Aug. 7, 1990**

[54] PACKAGE HAVING SUPPORTED GABLETOP CONTAINERS FOR TWO PART COMPOSITION

[75] Inventor: Roger H. Keith, Austin, Tex.

[73] Assignee: Minnesota Mining and Manufacturing Company, St. Paul, Minn.

[ * ] Notice: The portion of the term of this patent subsequent to Aug. 29, 2006 has been disclaimed.

[21] Appl. No.: 262,279

[22] Filed: Oct. 25, 1988

Related U.S. Application Data

[63] Continuation-in-part of Ser. No. 212,901, Jun. 29, 1988, Pat. No. 4,860,888.

[51] Int. Cl.[5] ..... B65D 85/30

[52] U.S. Cl. ..... 206/431; 206/433; 206/459; 206/568; 206/586; 206/588; 206/592; 220/23.83

[58] Field of Search ..... 206/433, 431, 432, 427, 206/586, 587, 592, 219, 568, 459, 588, 589; 220/22, 23.83

[56] References Cited

U.S. PATENT DOCUMENTS

| | | | |
|---|---|---|---|
| 363,690 | 5/1887 | Sleeper | 206/568 X |
| 2,260,424 | 10/1941 | Waters | 206/433 |
| 2,885,839 | 5/1959 | Weiss | 206/459 X |
| 3,331,502 | 7/1967 | Stroop et al. | 206/432 |
| 3,384,229 | 5/1968 | Kaschyk et al. | 206/431 |
| 3,424,301 | 1/1969 | Forrer et al. | 206/431 |
| 3,552,633 | 1/1971 | Ketler | 206/431 X |
| 3,595,384 | 7/1971 | Sargent et al. | 206/431 X |
| 3,784,082 | 1/1974 | Hurlock | 206/431 X |
| 4,213,529 | 7/1980 | Whitaker | 206/427 |

FOREIGN PATENT DOCUMENTS

| | | | |
|---|---|---|---|
| 40938 | 5/1965 | German Democratic Rep. | 206/433 |
| 2132173 | 7/1984 | United Kingdom | 206/503 |

*Primary Examiner*—Bryon P. Gehman

*Attorney, Agent, or Firm*—Donald M. Sell; Walter N. Kirn; John C. Barnes

[57] ABSTRACT

A package including containers having gabletops, wherein it is desired to maintain the containers in pairs, in separate areas, with support members to provide support for the gabletops from one side of the carton and identify the pairs of containers and separate them from other pairs of containers. The support members bridge the areas and are formed with panels adapted to engage the inclined roof panels of the gabletop containers and brace them from the wall of the carton to protect the ridge seal.

16 Claims, 4 Drawing Sheets

PACKAGE HAVING SUPPORTED GABLETOP CONTAINERS FOR TWO PART COMPOSITION

RELATED APPLICATIONS

This application is a continuation-in-part of U.S. patent application Ser. No. 212,901, filed June 29, 1988, now U.S. Pat. No. 4,860,888.

BACKGROUND OF THE INVENTION

1. Field of the Invention

This invention relates to an improved package for shipping and handling a composition that is contained in two separate containers and more particularity to a compartmented box for nesting pairs of said containers and in one aspect to a carton for pairs of gable-topped cardboard containers.

2. Description of the Prior Art

Prior to the present invention it has been customary to supply two part compositions for use in filling telecommunication splice closures in separate primary containers such as cans, two compartment plastic bags, tubes, or bottles. These containers were shipped in the conventional corrugated pasteboard box with honeycomb dividers between the individual containers to avoid rupture or the noise associated with contact between containers.

The prior art has not addressed the problem of packaging paired containers except separately in a shipping container with normal dunnage to separate the containers and to hold shorter containers from movement. There also exists collars formed for maintaining bottles upright or in spaced fixed relationship in a shipping container. Further, there are the bifold inserts used to maintain articles in separated position for shipping and handling.

Examples of the packaging for bottles or cylindrical containers are found in U.S. Pat. Nos. 758,239 (1904), 2,563,132, 2,868,428; examples of containers for special articles are found in U.S. Pat. Nos. 2,706,590 and 4,291,803; and examples of special folded inserts for packages are U.S. Pat. Nos. 3,101,166 and 3,921,890. Shipping and display cartons use special inserts or fillers to provide a nice neat appearing package, for example see U.S. Pat. No. 1,443,216 for a shoe shine outfit with a filling member positioned to leave sufficient space for a plurality, in this instance three, receptacles of different polishes or cleaning materials. These are patents do not include the known shrink wrap containers where a plurality of gable-topped containers for oil or the like are placed in a flat, or shallow tray, formed of card or chip board or from corrugated board and overwrapped with a heat shrinkable film to hold the cartons on or in a package.

In any event the prior art does not suggest a carton for two part products which come in an A and a B container, of the gabletop variety, wherein the pair of primary containers are nested and held in position to pass the standard drop tests and not rupture the relatively soft sided gabletop containers. Further, it is desired that the package aid in the identification of the gabletop containers of a pair.

The package is provided with a nest for the pair of pairs of containers and a gable top support piece for supporting the gabletops of the pair of containers to divert force normally applied to the ridge seal to the gables which are better able to stand the shipping trauma than the ridge seal of the containers. The support piece is removable to exposes a single pair of containers, an A and a B. The support piece is adapted for use in a multi-pair carton and restricts the possibility of mix-up or improper use of the ingredients of the multiple containers.

SUMMARY OF THE INVENTION

The present invention relates to a package for shipping and handling a pairs of containers of the gabletop variety. The package of the present invention comprises a plurality of gabletopped containers, a carton for the containers, means in the carton for nesting the containers in a pair or pairs within the carton, with the gabletops all at one side, and a support piece positioned at one side of the carton to make area contact with the gabletops of each pair of containers in each nested area for supporting the containers to restrict any load from being imposed solely to the ridge seal and affording identification of the pairs of containers. The individual support pieces comprise a bridge section spanning the ridge seal. The bridge section is supported from adjacent ends of support panels affording surface or area engagement with the inclined gable panels of the containers. Standing ribs are joined to and support the other ends of said support panels. The support piece preferably includes depending end tabs affording support for the sides of the carton insert and upper portion of the gabletopped containers. The support pieces also identify the nest area by indicia printed on the support piece and openings provided in a support panel to afford viewing access of the printed containers.

The blank for forming the support piece that spans the nest area for the containers is generally rectangular and has two parallel centrally disposed deep fold lines which leave a central strip, to either side of which are spaced fold lines defining the support panels. The blank is slit at areas spaced from two opposite edges, by parallel slits extending perpendicular to the fold lines. The cardboard between the ends and the slits define the end tabs to brace the protective walls.

The carton comprises six walls including a bottom, four side walls and flaps hinged to the side walls to form a top wall. Inside the side walls is positioned at least one partition to divide the interior of the carton into a plurality of areas each of sufficient space to receive a pair of gabletop containers. In the preferred package, an insert assembly is placed in the carton having protective walls spaced inwardly of the side walls and a plurality of interlocking partitions span the area within the protective walls and interlock therewith to space the protective walls from the side walls of the carton to define a plurality of nest areas for containers having their gabletops adjacent the top side of the carton.

BRIEF DESCRIPTION OF THE DRAWING

The present invention will be further described with reference to the accompanying drawing, wherein.

DETAILED DESCRIPTION OF THE PREFERRED EMBODIMENT

Figure 1:
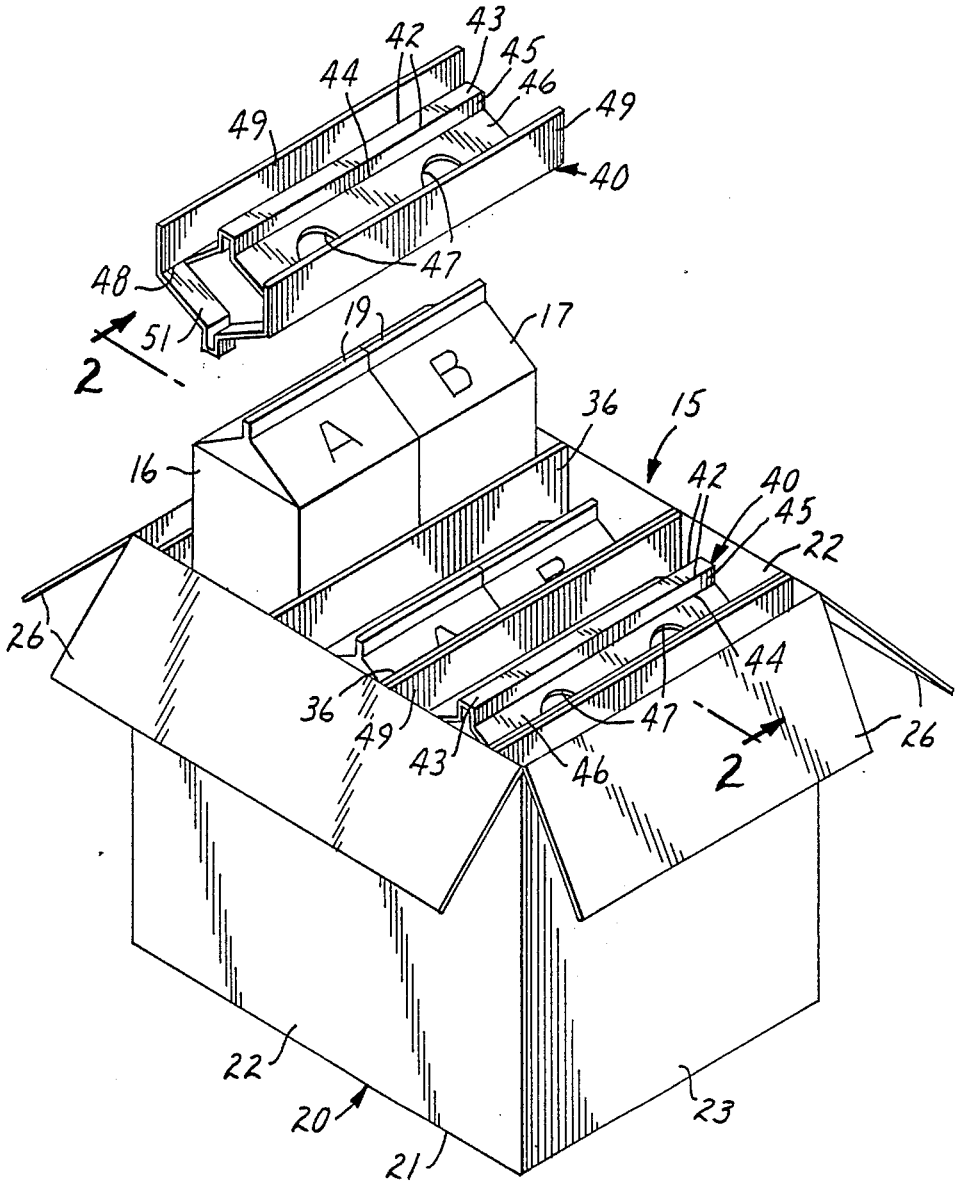
FIG. 1 is a perspective partially exploded view of a package according to the present invention including the gabletop container support piece and containers.
Figure 2:
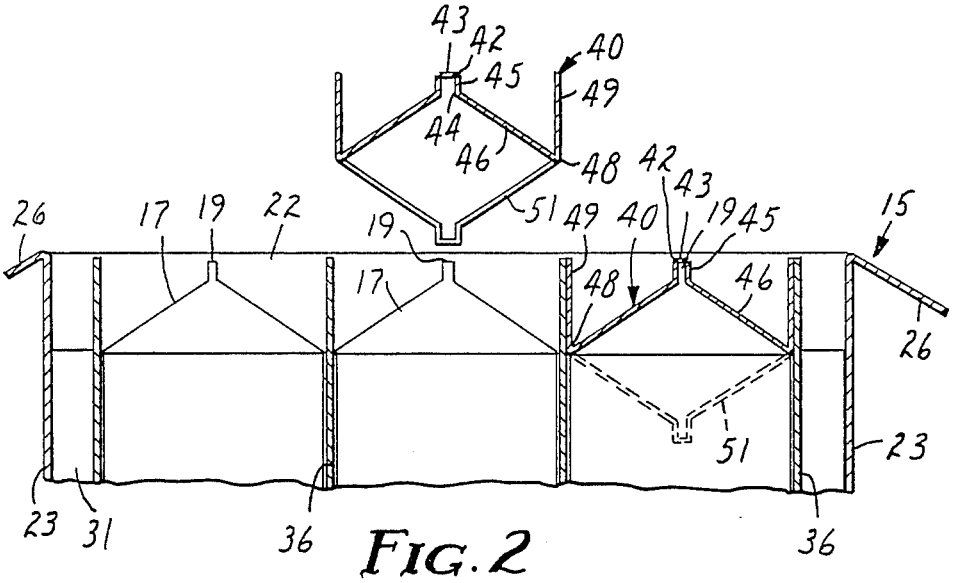
FIG. 2 is a longitudinal sectional view of the package of FIG. 1.

Referring now to the drawing the invention will be described with reference to the accompanying drawing. In the description like reference numerals will refer to like parts throughout the several views.

FIG. 1 illustrates a package 15, illustrated in exploded perspective, for shipping and handling a plurality of pairs of gabletop primary containers, each pair comprising a container A 16 containing a first compound adapted to be mixed with the contents of a second container B 17. The package 15 comprises a carton 20 comprising six walls, i.e., a bottom 21, four side walls, two longitudinal side walls 22 and two end walls 23, and a top wall. Each of the side walls 22 have a flap 26 hinged thereto at a foldline, to form the top wall. The exact manner of closing the carton by flaps may vary.

Figure 6:
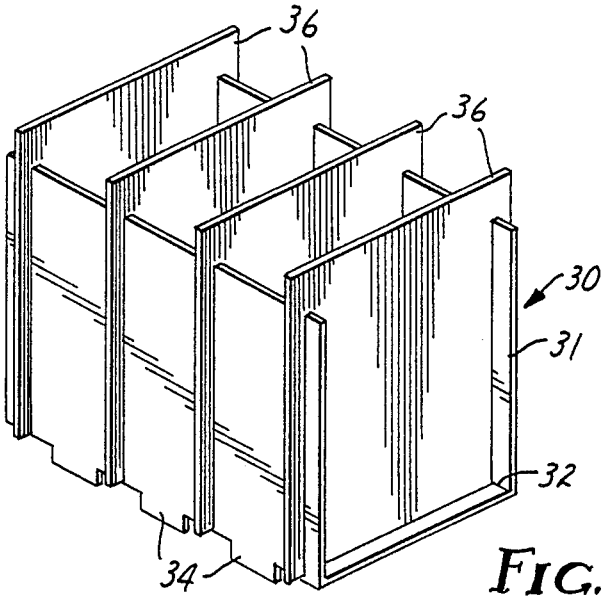
FIG. 6 is a perspective view of the insert and several partitions assembled for insertion in the carton.
Figure 7:
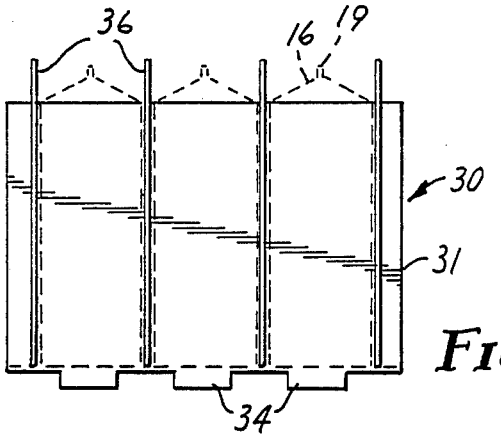
FIG. 7 is a side view of the assembly of FIG. 6.
Figure 8:
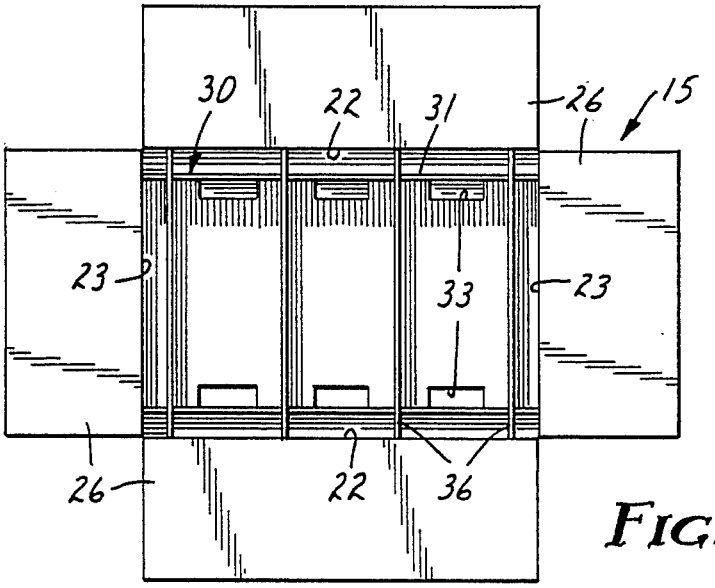
FIG. 8 is a top view of the assembly of FIG. 6 in a carton.

An insert assembly 30, see FIG. 6, is placed in the carton 20 to divide the same into a plurality of nest areas each of which has sufficient space to receive a pair of the gabletop containers 16, 17 containing the desired quantity of material, which when removed from the carton and mixed together form a composition for use in filling a splice closure. Each container 16 and each container 17 are constructed in a manner well known in the art and have a gabletop including two inclined roof panels terminating in a ridge seal 19 which top may be opened at one end of the ridge seal to obtain access to the contents. Normal opening of the container produces a pouring spout for dispensing the contents of the container. The fact that one container 16 together with one container 17 contain the ingredients of the filling compound make it necessary to restrict the possibility of error and the use of two containers of the composition of container 16 or of container 17. This can happen if the containers are shipped separately or the containers are separated in the box, i.e. with containers 16 on one side and containers 17 on the other side of the box, or each in a separate isolated area such as the bottles in a honeycomb in a case.

A support and pair identifying piece 40 is formed from a sheet of packaging material, such as corrugated pasteboard, and spans the nest area containing a pair of the containers 16 and 17. This support piece 40, as will be described later, fits transversely of the carton 20 and is shaped to make area contact with the inclined roof or gable panels of the containers sufficiently to restrict any damage to the ridge seals 19. The support piece is formed to engage the two containers in each nest area along at least one inclined roof or gable panel of each container. This will serve to spread the load to a large area of the container for restricting rupture of the containers in the event the package is dropped.

In the illustrated embodiment, there are three support pieces 40. Each support piece spans only one nest area. Each support piece is individually removable and upon removal a pair of the containers 16, 17 may be withdrawn from the carton.

Figure 3:
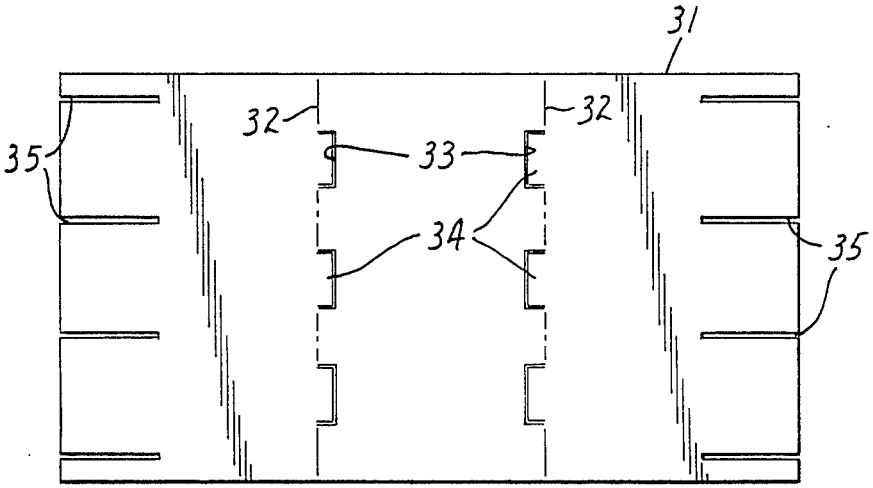
FIG. 3 is a plan view of a blank for a package insert.
Figure 5:
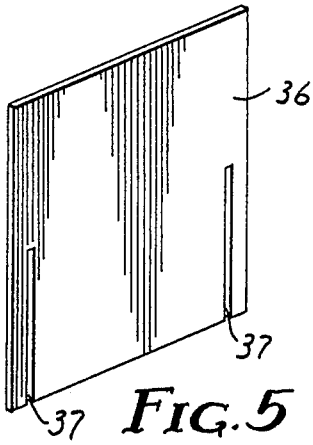
FIG. 5 is a side view of a partition.
Figure 4:
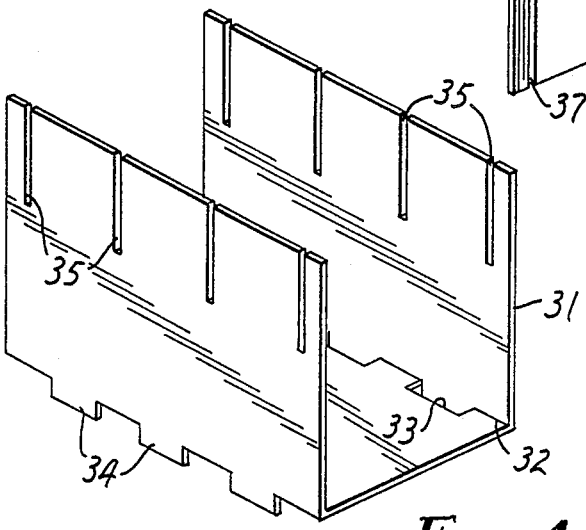
FIG. 4 is a perspective view of the blank of FIG. 3 folded for use.

Referring now to FIGS. 3 through 8 inclusive, there is shown the blank 31 for forming the shell of the insert 30, the formed shell, the partition 36, and the assembled insert. The blank 31 is formed from a generally rectangular sheet of pasteboard and has two parallel fold lines 32 extending lengthwise of the blank as shown in FIG. 3 spaced symmetrically one on each side of the center line. Along the fold lines 32, the blank is formed with U-shaped cuts 33, for defining legs or spacers 34 when the blank is folded along the lines 32 to form a channel having a bottom and upwardly projecting protective side walls. A number of slits 35 are formed in the longitudinal edges. These slits 35 extend toward the fold lines 32 a distance which is about half the distance from the edge to the fold line. The slits 35 are symmetrical along the opposite edges. The size of the blank 31 and the number of the nests depend on the size and number of containers to be placed in a package. Partitions 36 are formed of cardboard and one edge, the bottom edge as illustrated in FIG. 5, is formed with two slits 37 which cooperate with the slits 35 to receive the partitions 36 in positions spanning the sides of the channel formed of the blank 31. Four partitions 36 are used in the insert 30 to form the three nest areas for the containers 16, 17. The edges of the partitions 36 that extend beyond the slits 37 brace the protective walls defined by the sides of the channel from the side walls 22 of the carton 20. The insert assembly is then placed in the carton 20. A container A and a container B is then placed in each of the nest areas.

Figure 9:
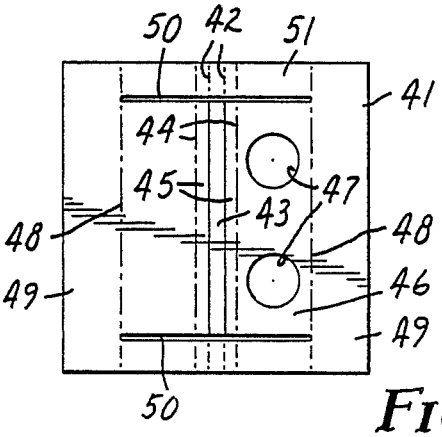
FIG. 9 is a plan view of a blank for the support piece.
Figure 10:
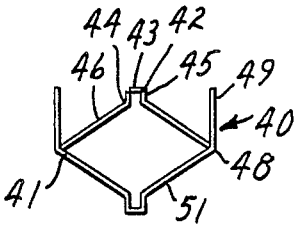
FIG. 10 is an end view of the support piece formed from the blank of FIG. 9.

The support piece 40 is formed from a blank 41 as illustrated in FIG. 9. The blank 41 is formed with a series of fold lines. Adjacent the center line are two parallel fold lines 42 which are cut to a depth in the cardboard to expose the corrugations and a central strip or band 43 formed between the fold lines 42 has a width sufficient to span the thickness of the ridge seal 19 on the containers 16, 17. Between the fold lines 42 and the next fold lines 44 are legs 45, which complete the bridge spanning the ridge seal 19. The legs 45 are thus connected via the fold lines 44 to support panels 46 which have a length and width to contact a substantial portion of the inclined roof panels of the containers. One of the panels 46 is formed with a pair of circular openings 47 for allowing visual access to the labels on the containers identifying them as "A" and "B". Other printed indicia or legends can be applied to these panels also, such as a label "ONE KIT". The panels adjacent the edges of the blank and joined to the panels 46 by fold lines 48, form standing ribs 49 which are disposed adjacent to the partitions 36 and serve to hold the support panels 46 against the inclined roof panels of the containers. Fold lines 44 and 48 are formed by compressing the pasteboard and the folded pasteboard serves to urge the ribs 49 against the partitions 36 and maintain the support panels in position to engage the inclined roof panels of the containers. The blanks 50 are also provided with slits 50 cut through the pasteboard. The slits 50 are positioned adjacent opposite edges of the blank and perpendicular to the fold lines 44 and 48 and extend between fold lines 48 on opposite longitudinal sides of the blank. The pasteboard in the area between the slits 50 and the adjacent edge form end tabs 51 for the support piece. These end tabs 51 have a width such that they fit between the protective wall of the insert assembly 30 and the side wall 22 of the carton 20. These end tabs are formed by folding the pasteboard in the opposite direction from that between the slits 50 to define inclined walls and a U-shaped portion spaced from the bridge means defined by legs 45 and strip 43. The end tabs 51 support the protective wall above the base of the slits 35 such that the wall does not tend to bend or fold if the package is dropped on one longitudinal side 22 or the other. In the assembled package the central strip 43 and the free ends of the standing ribs 49 extend to the height of the partitions 36 and contact the top side of the package when the flaps 26 are folded upon themselves and sealed.

Having described the present invention with reference to the preferred embodiments, it will be understood that modifications may be made therein without departing from the scope of the present invention as defined in the appended claims.

What is claimed is:

1. A package for shipping a plurality of gable-topped containers comprising:

a plurality of containers with bottom walls, side walls and gabletops including inclined roof panels connected by a ridge seal, a rigid carton having wall means defining at least one cavity for receiving a pair of said containers and for supporting said container bottom and side walls and for supporting said gable-tops, and support means for supporting the gabletops of said containers in said cavity from said wall means adjacent said gabletops, said support means comprising a support piece having leg and rib means extending from a support panel juxtapositioned to a roof panel of each container affording area contact therewith for supporting said support panel from said wall means a distance sufficient for retaining said ridge seals from engagement with said wall means.

2. A package according to claim 1 wherein said support piece comprises a folded piece of pasteboard having a pair of sides and ends with fold lines extending between said ends for defining a pair of said leg means and a center strip for bridging said ridge seal, additional fold lines for defining a pair of said support panels and said rib means, whereby said support piece will span the cavity adjacent said gabletops and said leg and rib means will contact said wall means to support said containers from said wall means.

3. A package according to claim 2 wherein one of said support panels has means for identifying a said pair of containers.

4. A package for a plurality of gable-topped containers containing compositions that are to be mixed, i.e. the contents of one container with the contents of another container, and the containers are provided in the package in an equal number of the containers of each composition, said package comprising:

a plurality of containers each with a bottom wall, side walls and gabletops including inclined roof panels joined by ridge seals, said containers including a plurality of containers of a first composition and an equal number of containers of a second composition, rigid carton having wall means defining a cavity and flap means connected to said wall means for forming additional wall means closing said cavity, dividing means for dividing said carton cavity into nesting areas for nesting pairs of said containers, said dividing means including partitions and protective side walls defining each nesting area and affording support for said side walls of one of said pairs of said containers, said pairs each comprising a container having a first composition and a container having a second composition, in each said area, and support means for supporting the gabletops of said containers in each area, said support means comprising support panels juxtapositioned to at least one inclined roof panel of each container in each of said areas and rib means for maintaining said support panels a fixed distance from an adjacent wall means.

5. A package according to claim 4 wherein said dividing means comprises a plurality of intersecting sheets of pasteboard formed with slotted openings to cooperate with each other to divide said cavity into a plurality of rectangular areas.

6. A package according to claim 5 wherein said dividing means separate said nesting areas from said wall means of said carton for defining an open space therebetween.

7. A package according to claim 6 wherein said support piece comprises end tabs at opposite ends of said support panels and positioned in said open space between said wall means and said dividers for supporting said dividers.

8. A package according to claim 4 wherein said support means bridge each said nesting area by joining two said sheets forming a said area.

9. A package according to claim 8 wherein said support means comprises a folded piece of pasteboard having a pair of support panels juxtapositioned to said roof panels and joined along adjacent edges by bridge means spanning said ridge seal of the containers in each nesting area and rib means at the other edges of said panels to space said other edges from said wall means and adjacent said roof panels of said containers.

10. A package according to claim 4 wherein said support means comprises a folded piece of pasteboard having a pair of support panels juxtapositioned to said roof panels and joined along adjacent edges by bridge means spanning said ridge seal of the containers in each nesting area and rib means at the other edges of said support panels to space said other edges from said wall means and adjacent said roof panels of said containers.

11. A package according to claim 10, wherein said support piece comprises end tabs at opposite ends of said support panels and spaced from said bridge means for supporting said dividing means on a side opposite said containers.

12. A package according to claim 10 wherein indicia means is placed on one of said support panels for identifying said containers in each said area as a pair of containers, the contents of which are to be combined.

13. A package for a plurality of gable-topped containers containing compositions that are to be mixed, i.e. the contents of one container with the contents of another container, and the containers are provided in the package in an equal number of the containers of each composition, said package comprising:

a plurality of containers with gabletops including inclined roof panels joined by ridge seals, said containers including a plurality of containers of a first composition and an equal number of containers of a second composition, a rigid carton having wall means defining a cavity and flap means connected to said wall means for forming additional wall means closing said cavity, dividing means for dividing said carton cavity into areas for nesting pairs of said containers, said pairs each comprising a container having a first composition and a container having a second composition, in each said area, and support means for supporting the gabletops of said containers in each area, said support means comprising support panels juxtapositioned to at least one inclined roof panel of each container in each of said areas, rib means for maintaining said support panels a fixed distance from an adjacent wall means, and end tabs at opposite ends of said support panels and positioned between said wall means and said dividing means for supporting said dividing means.

14. A package according to claim 13 wherein said dividing means separate said nesting areas from said wall means of said carton for defining an open space therebetween.

15. A package according to claim 13 wherein said support means comprises a folded piece of pasteboard having a pair of support panels juxtapositioned to said roof panels and joined along adjacent edges by bridge means spanning said ridge seal of the containers in each nesting area and rib means at the other edges of said support panels to space said other edges from said wall means and adjacent said roof panels of said containers.

16. A package according to claim 15 wherein said end tabs are positioned at opposite ends of said support panels and spaced from said bridge means for supporting said dividing means on a side opposite said containers.

* * * * *